US005522541A

United States Patent [19]

Zia et al.

[11] Patent Number: 5,522,541

[45] Date of Patent: Jun. 4, 1996

[54] METHOD FOR PROVING FURNACE HIGH-HEAT PRESSURE SWITCH

[75] Inventors: Ninev K. Zia, Indianapolis; Daniel J. Dempsey, Carmel; Hall Virgil, Jr., Brownsburg, all of Ind.

[73] Assignee: Carrier Corporation, Syracuse, N.Y.

[21] Appl. No.: 322,948

[22] Filed: Oct. 12, 1994

[51] Int. Cl.[6] ..... F23N 1/00

[52] U.S. Cl. ..... 236/10; 126/116 A; 236/15 C; 431/19

[58] Field of Search ..... 236/15 C, 10, 236/94, 1 EB; 431/19; 126/116 A

[56] References Cited

U.S. PATENT DOCUMENTS 4,887,767 12/1989 Thompson et al. ..... 236/10 X
4,976,459 12/1990 Lynch ..... 236/1 EB
4,982,721 1/1991 Lynch ..... 126/116 A
5,027,789 7/1991 Lynch ..... 126/116 A
5,186,386 2/1993 Lynch ..... 126/11
5,379,752 1/1995 Virgil, Jr. et al. ..... 126/116 R

*Primary Examiner*—William E. Wayner

[57] ABSTRACT

In a two-stage furnace system, including a thermostat, at least one gas burner with a low and high-fire operating capability, an inducer fan having low and high speed operating settings, and a high-fire pressure switch, a method for handling the high-fire pressure switch being in an inappropriately open condition. The method has the steps of: determining whether the thermostat is issuing a call for high heat and, if it is, determining if the high-fire pressure switch is open. If the high-fire pressure switch is open, waiting a predetermined time, determining if the high-fire pressure switch is still open and, if it is, completing a furnace shutdown procedure, then initiating a normal shutdown, then an ignition sequence in high-speed inducer pre-purge mode, determining if the high-fire pressure switch remains open, and if so, running at least one gas burner in low-fire mode. If, while these steps are being performed, the high-fire pressure switch closes, running the system in high-fire mode.

18 Claims, 7 Drawing Sheets

METHOD FOR PROVING FURNACE HIGH-HEAT PRESSURE SWITCH

BACKGROUND OF THE INVENTION

1. Field of the Invention

This invention relates to multi-stage gas-fired furnaces and, more particularly, to a method for proving the high-heat pressure switch in a multi-stage gas-fired furnace.

2. Description of the Prior Art

During certain situations in the operation of a multi-speed furnace, problems can arise in that the high-fire pressure switch (HPS) may fail to close or may, due to an increase in pressure in its immediate vicinity, open while in high-fire. The former situation can occur in longer length vent systems at high altitude and on furnaces with higher rise ranges. The latter situation can occur when the furnace is already operating in high-fire mode as previously requested, and may be caused, for example, by a high wind gust impinging a horizontal vent. In either case, when nothing is done about the HPS being open, the system will normally attempt to satisfy the thermostatically communicated high-heat demands using low heat if the HPS does not close. If successful, the furnace would be required to run for an excessive period of time in low-fire mode in order to satisfy the thermostat, and it will take longer than desirable for the temperature to reach the pre-set comfort level. When the furnace is recovering from night set-back the loss of high-fire heat may result in the system taking many hours to regain the desired temperature. In some instances, heat delivered in the low-fire mode may not be sufficient to satisfy the thermostat and the temperature in the conditioned space will become low enough to cause occupant discomfort.

In the prior art, in particular copending U.S. patent application Ser. No. 08/090,332, assigned to a common assignee, an interlock is provided between the high-fire pressure switch and the high-fire solenoid to prevent the high-fire solenoid from being energized when the furnace is in low fire mode. Twenty four volt thermostat power is denied to the high-fire pressure switch and high-fire solenoid whenever there is a call for low heat.

In U.S. Pat. Nos. 4,982,721, 5,027,789 and 5,186,386 all to Lynch, the system attempts to deal with the problem of the high-fire pressure switch remaining closed (causing the system to run in high-fire mode with respect to the amount of fuel delivered) when the inducer fan is running at low speed—that is the combustion air is being delivered at a volume appropriate for low-fire mode. This is done before gas ignition is attempted by running the inducer fan on low speed for 1 minute, turning off the inducer fan for 4 minutes, and running the inducer fan on high speed for 15 seconds before starting another cycle.

None of these documents address the problem of the high-fire pressure switch failing to close when it should, or reopening during high-fire mode operation.

SUMMARY OF THE INVENTION

It is therefore a primary object of the present invention to provide a method for closing the high-heat pressure switch in a multi-stage gas-fired furnace.

It is a further object of this invention to provide a method for handling an inappropriately open state of the high-fire pressure switch.

It is yet a further object of this invention to provide a method for handling the failure of closure of the high-fire pressure switch when the furnace thermostat is calling for high-fire.

It is still another object of this invention to provide for heating of the conditioned space when the high-fire pressure switch fails repeatedly to close.

It is yet another object of this invention to provide a method for handling the improper opening of the high-fire pressure switch while the furnace thermostat is operating in high-fire mode.

It is still another object of this invention to provide for heating of the conditioned space when the high-fire pressure switch fails to reclose after having opened during furnace operation in high-fire mode.

These and other objects of the present invention are attained by, in a two-stage furnace system, including a thermostat, at least one gas burner with a low and high-fire operating capability, an inducer fan having low and high speed operating settings, and a high-fire pressure switch, a method for handling the high-fire pressure switch being in an inappropriately open condition. The method has the steps of: determining whether the thermostat is issuing a call for high heat and if it is, determining if the high-fire pressure switch is open. If the high-fire pressure switch is open, waiting a predetermined time, determining if the high-fire pressure switch is still open and if it is, then completing a furnace shutdown sequence, initiating an ignition sequence in high-speed inducer pre-purge mode, determining if the high-fire pressure switch remains open, and if so, running the gas burner in low-fire mode. If, while these steps are being performed, the high-fire pressure switch closes, the system is run in high-fire mode.

BRIEF DESCRIPTION OF THE DRAWINGS

For a better understanding of these and other objects of the present invention, reference is made to the detailed description of the invention which is to be read in conjunction with the following drawings, wherein.

DETAILED DESCRIPTION OF THE INVENTION

Figure 1:
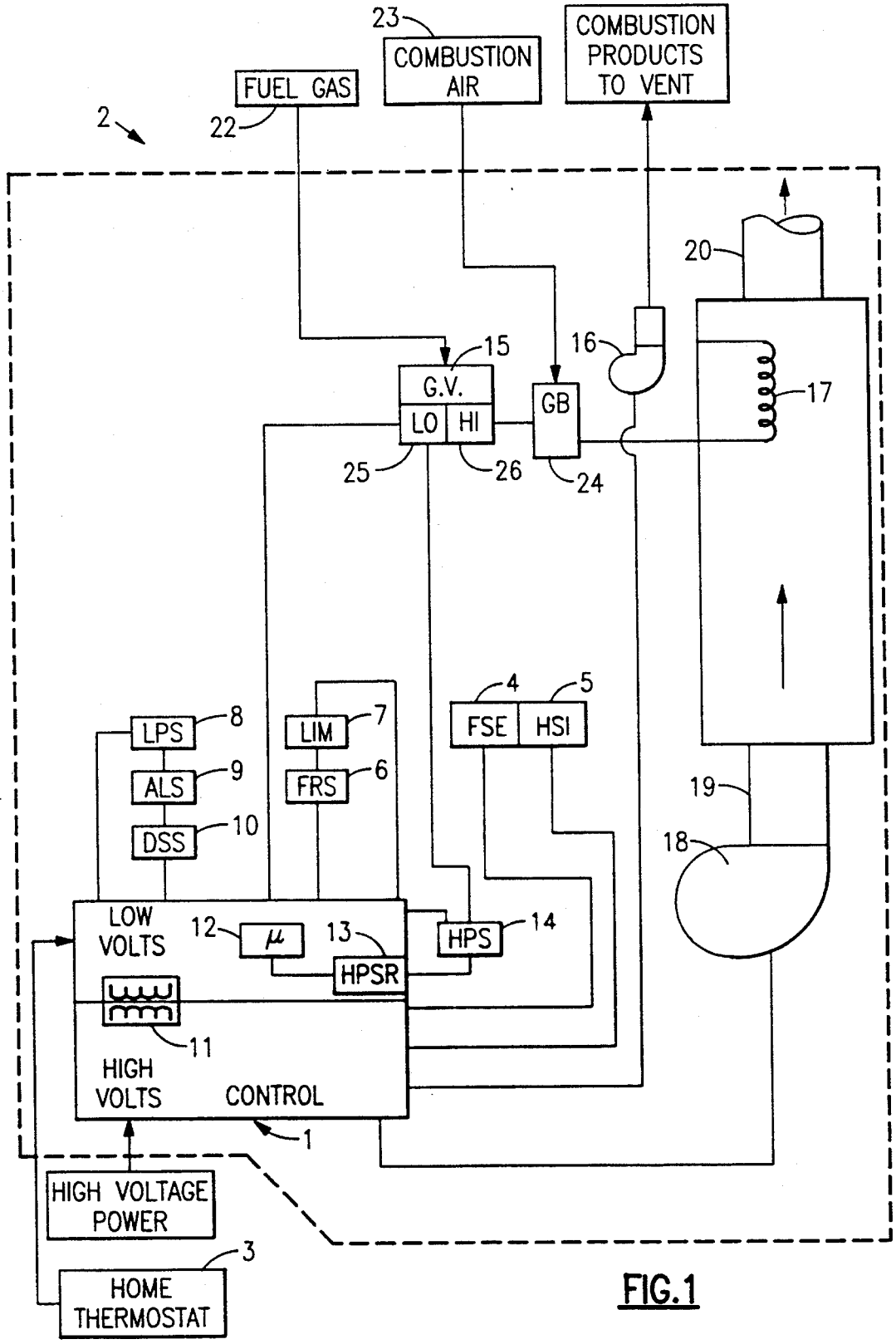
FIG. 1 is a schematic diagram of the two stage furnace illustrative of the present invention.

Turning now to the Drawing and particularly, FIG. 1 thereof, there is shown a schematic of a typical two stage furnace such as may be controlled by the process of the instant invention, the furnace schematic being indicated generally as 2. The present invention is dependent upon the microprocessor 12 which controls the operation of the furnace generally and in particular the process of this invention, microprocessor 12 having located therein memory and the control program therefore. Although the microprocessor 12 is shown herein with respect to a particular furnace system, the invention encompasses other arrangements which involve the operation of a two-stage furnace.

Microprocessor 12 is located on furnace control 1 which also holds transformer 11, which functions to convert some of the high voltage power received by the control 1 to the low voltage power needed for the flame rollout switch 6, limit switch 7, low-fire pressure switch 8, auxiliary limit switch 9, draft safeguard switch 10, high-fire pressure switch relay 13, and high-fire pressure switch 14, all of whose functions in controlling the gas valve will be described hereinafter.

Figure 2:
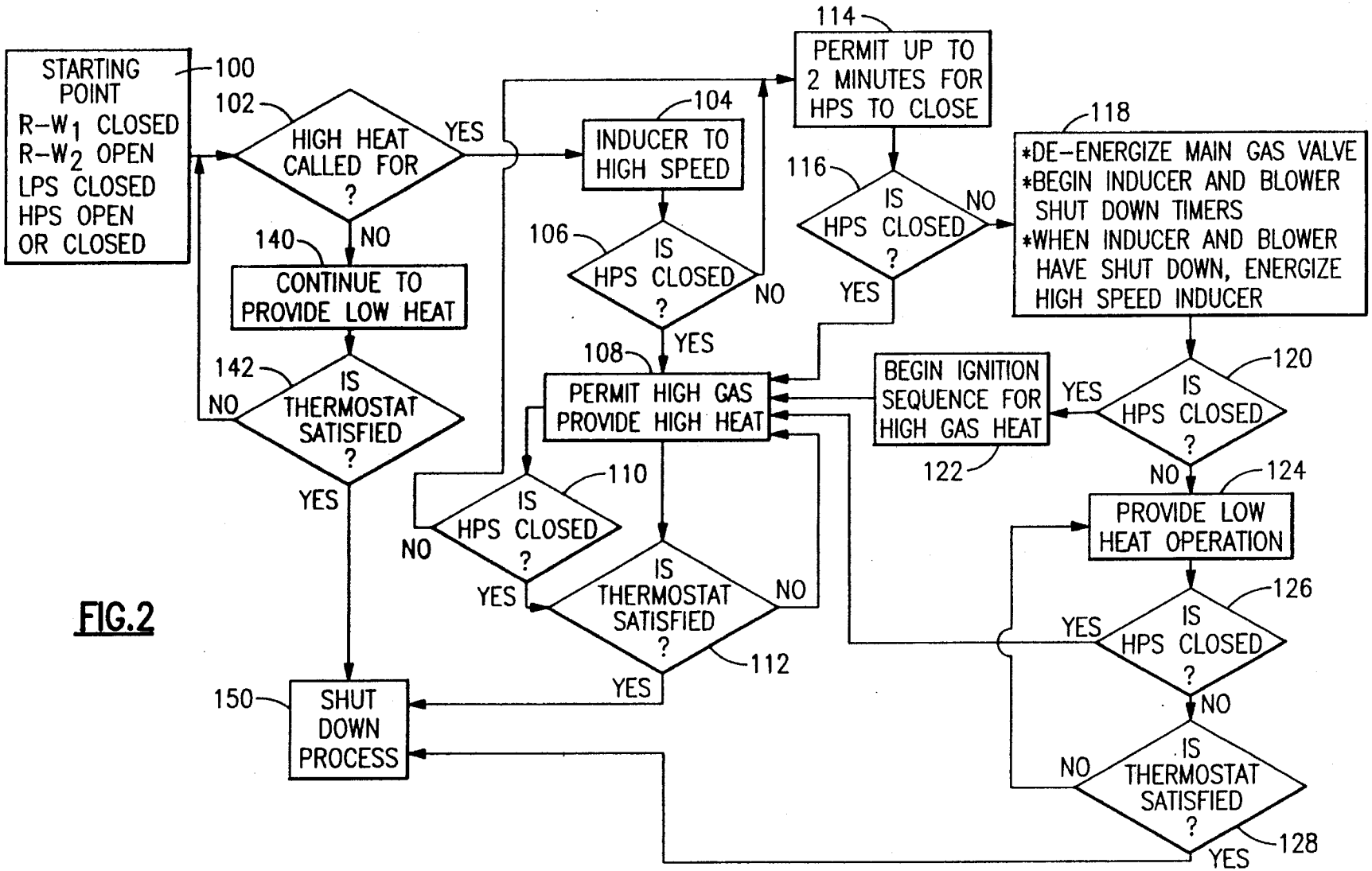
FIG. 2 is a flow chart of the process for handling the HPS not closing upon a call for high-fire heat.

In the normal operation of the furnace, a call for heat is issued by the thermostat 3. The thermostat 3 call for heat is relayed to microprocessor 12. This call may be either for low-fire heat in which case the R-W1 connection (not shown), discussed hereinafter with respect to FIG. 2, is closed and the R-W2 (not shown) connection is open. Or it may be for high-fire heat in which case both the R-W1 and R-W2 connections are closed.

If there is a call for heat, the inducer starts and, if the pressure switch(es) is(are) closed, the ignition sequence starts and the hot surface ignitor 5 is activated and serves to ignite the fuel gas. Combustible fuel gas is delivered into the system through the gas valve 15 via a line from fuel gas source 22. The amount of fuel gas delivered is controlled by gas valve 15. Gas valve 15 contains high-fire 26 and low-fire solenoids 25 that control the proper rate of gas delivery for high-fire and low-fire operation respectively. The low-fire solenoid is controlled by microprocessor 12, while the high-fire solenoid is controlled directly by the high-fire pressure switch 14. The high-fire pressure switch 14 determines the presence or absence of sufficient combustion air for the high-fire heating operation, being normally closed when there is sufficient combustion air and open when there is not.

The fuel gas is mixed with combustion air provided from a combustion air source 23, ignited at GB (gas burner(s)) 24 and directed to heat exchanger(s) 17 which transfer the heat of combustion to the air which circulates through the conditioned space. Two speed inducer motor 16 draws the combusted fuel/air mixture through the heat exchanger(s) 17 and delivers the cooled mixture to the vent system 21 so as to vent it from the building.

Simultaneously, multi-speed blower motor 18 (in this case a 4-speed one) moves circulating interior air from the return air plenum 19 through the furnace 2, over the heat exhanger(s) 17, and finally supplies it in its heated state through supply air ducts 20 as supply air back to the conditioned space (not shown).

When the call is specifically for high heat, the high-fire pressure switch relay 13 is closed by the microprocessor 12. When open, the high-fire pressure switch relay 13 interrupts electrical current to both the high-fire pressure switch 14 and the high-fire solenoid 26 on gas valve 15.

Hardware is supplied in order to detect and allow the system to correct for a number of possible error conditions of the furnace system 2. Flame rollout switch 6 detects unacceptably high burner assembly temperatures and functions to halt the heating operation when this situation occurs. Heating is also terminated when the limit switch 7 detects unacceptably hot air passing over the heat exchangers and to the conditioned space.

The low-fire pressure switch 8 operates analogously to the high-fire pressure switch 14 in that it detects whether or not there is sufficient combustion air for the low-fire heating operation. Low-fire pressure switch 8 is not as likely to be opened due to transient conditions as is high-fire pressure switch 14.

The auxiliary limit switch 9 functions typically in downflow and horizontally installed furnaces (as compared with upflow furnaces) to detect whether the multi-speed blower is not operating. In this case the heated air tends to flow in the reverse direction. When this situation is detected the auxiliary limit switch 9 opens, signalling the system to halt heating operations. Heating is also halted when the draft safeguard switch 10 detects an obstruction in the furnace vent system.

The process for detecting and handling the situation where the high-fire pressure switch (HPS) 14 fails to close when high-fire operation is requested by the system from a steady-state low-fire condition, is shown in FIG. 2. Initially, in step 100, R-W1 (the thermostat connection which indicates a call for low-fire heat) is closed and R-W2 (the thermostat connection which indicates a call for high-fire heat) is open. The low-fire pressure switch (LPS) 8 is closed, while the high-fire pressure switch 14 can be either open or closed. In step 102 a determination is made as to whether high heat is being called for. If so, then in step 104 the inducer is set to high speed and in 106a determination is made as to whether HPS 14 is closed. If so then in 108the gas flow is set to high, providing high heat. Then in 110HPS 14 is tested to determine if it is closed. If so, then in 112a determination is made as to whether the thermostat is satisfied. If it is not then the routine loops back to 108so that HPS 14 is essentially continuously checked until it is either open or the thermostat is satisfied.

Returning now to steps 110and 106,if HPS 14 is not closed upon either of these determinations, then in 114 the system waits for up to 2minutes for the HPS 14 to close. The choice of two minutes is based on a compromise between allowing the high-fire pressure switch 14 sufficient time to close, and not delaying the delivery of high-fire heat so long as to cause discomfort to the occupant(s) of the conditioned space. Any time value in the range of 0seconds to 30 minutes would be reasonable. In 116the state of HPS 14 continues to be tested. If it is closed, the situation has normalized and control returns to 108.If, on the other hand, it is still open, then an attempt to close it is made in 118.The main gas valve is de-energized and the inducer and blower shut down timers are started, for the normal inducer post-purge and blower-off delays. When the inducer and blower have been shut down, the high speed inducer is energized. This initiation of the ignition sequence in high-speed inducer pre-purge should result in the high-fire pressure switch 14 closing, since the unfired cold purge heat exchanger pressure drop, with the inducer in high speed, is greater than the fired, low-fire heat exchanger pressure drop with the inducer in high speed.

After this attempt to close the high-fire pressure switch 14, its status is tested in 120.If it is closed, then in 122the ignition sequence for high-fire heat is initiated and the process loops back to 108.If HPS 14 is not closed then in 124low-fire operation is provided using the high-fire heating blower speed, so that there is heating to the conditioned space.

While operating in the low-fire mode the system continuously tests whether HPS 14 has closed in 126, returning control to 108if it has, and testing to see if the thermostat is satisfied in 128if it has not. If the thermostat is not satisfied then the system loops back to provide additional low-fire heat in 124,while if the thermostat is satisfied the process is terminated in 150. Shut down 150is alternatively carried out if the thermostat satisfied test of 112is met.

Returning now to 102,if there is no call for high heat then provision of low-fire heat is continued in 140, and a check is made in 142to see if the thermostat is satisfied. If it is, then the 150termination is performed and if it is not, control loops back to 102 essentially continuously monitoring for a call for high heat.

In summary, if the HPS 14 is not closed upon a call for high heat then, after a delay, if the HPS remains open, the system goes through a normal shutdown and a pre-purge sequence in an attempt to create a pressure differential between the high-fire pressure switch 14 and the burner area, sufficient to close the HPS 14. If this is not achieved, then heating is provided to the conditioned space using low-fire heating with high-fire heating blower speed until such time as either the thermostat call for heat is satisfied or the high-fire pressure switch 14 is closed, permitting high-heat operation.

Figure 4:
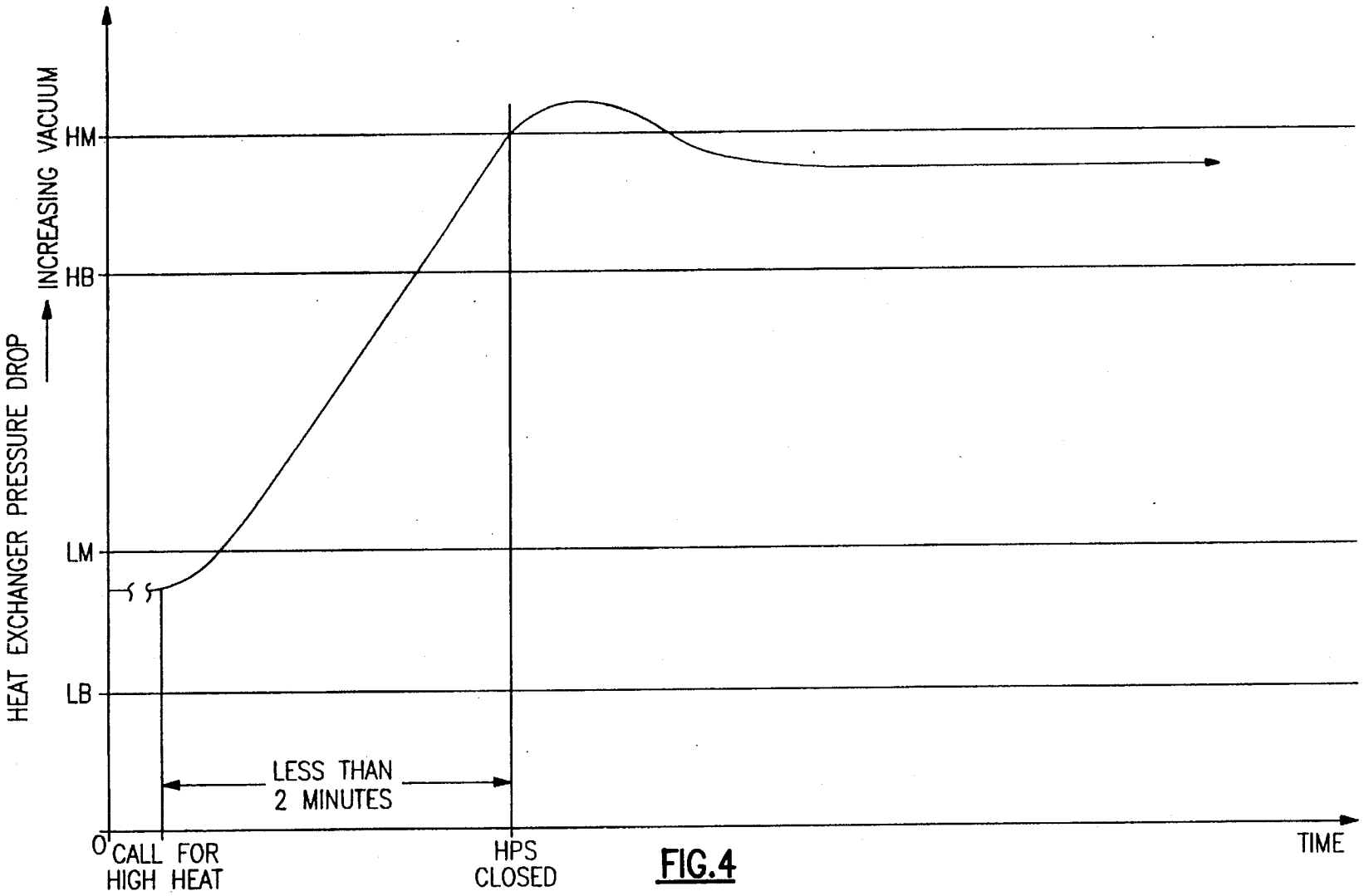
FIG. 4 is a graphical illustration of the furnace system pressure and its effect on the status of the high-fire pressure switch as a function of time, during a normal call for high heat with proper closure of the HPS.

The relationship of the heat exchanger pressure drop to furnace functioning over time under normal conditions is shown in FIG. 4. In FIG. 4 and all succeeding figures, HM is the high-fire pressure switch closure point, HB is the high-fire pressure switch open point, LM is the low-fire pressure switch closure point, and LB is the low-fire pressure switch open point, Normally then, within less than two minutes of the call for high-heat, from a low-heat operating mode, there is sufficient pressure drop in the region of the high-fire pressure switch 14, caused by the inducer motor operating at high speed and providing sufficient air to support the high-fire gas input rate, to cause the HPS 14 to close. Once it is closed, it remains closed, and the system proceeds into high-fire until such time as the thermostat is satisfied.

Figure 5:
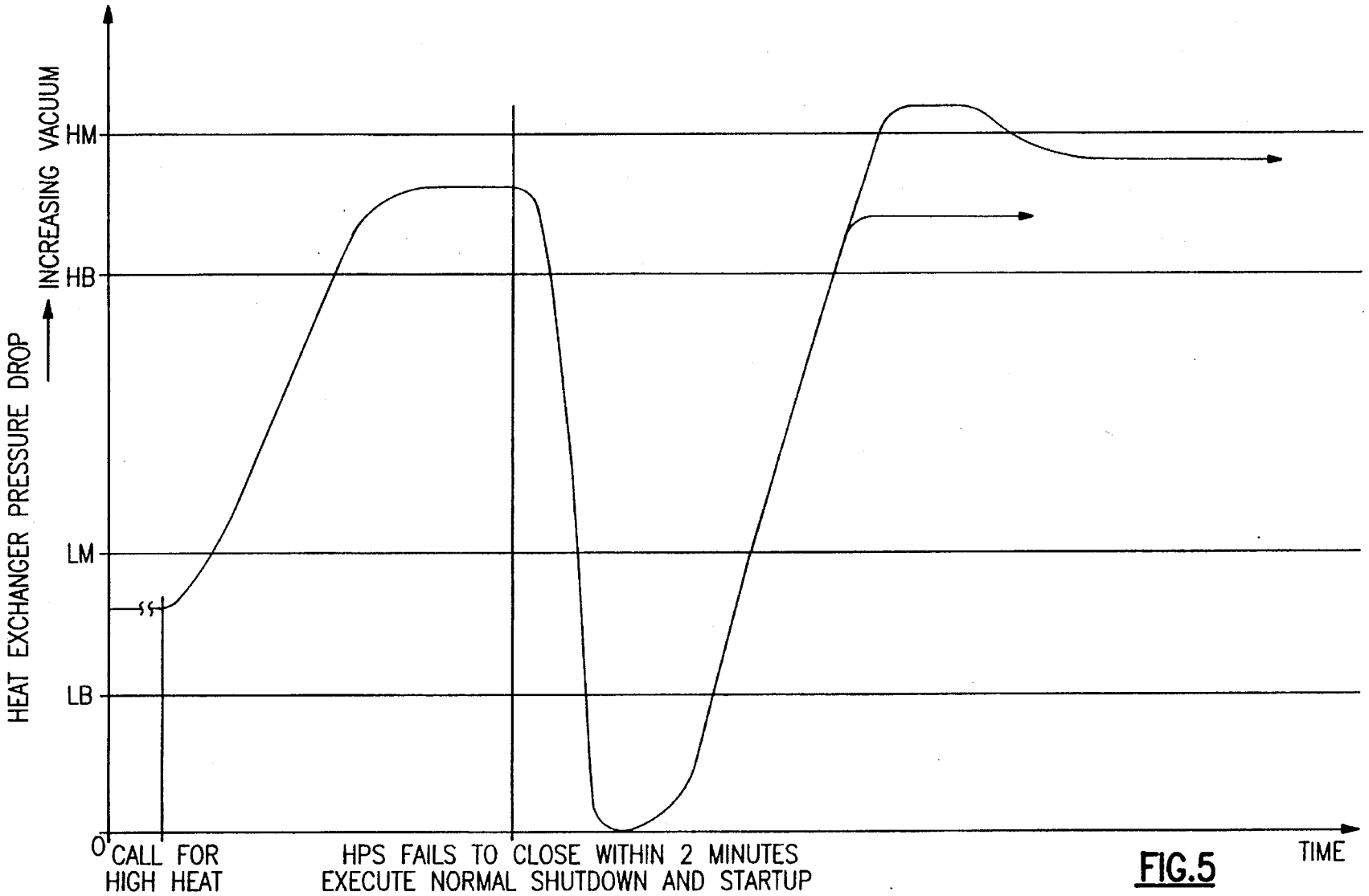
FIG. 5 is a graphical illustration of the furnace system pressure and its effect on the status of the high-fire pressure switch as a function of time, when the high-fire pressure switch fails to close and the handling thereof according to the instant invention.

FIG. 5 shows the situation where there is a call for high-fire heat while in low-heat, but there is an insufficient pressure drop for the HPS 14 to close. After two minutes, normal shutdown procedures are initiated. Once the shutdown is complete, a normal unfired startup begins with high speed inducer operation, and thereafter either the HPS 14 will close as is shown in line A or fail to close again as shown in line B.

Figure 3:
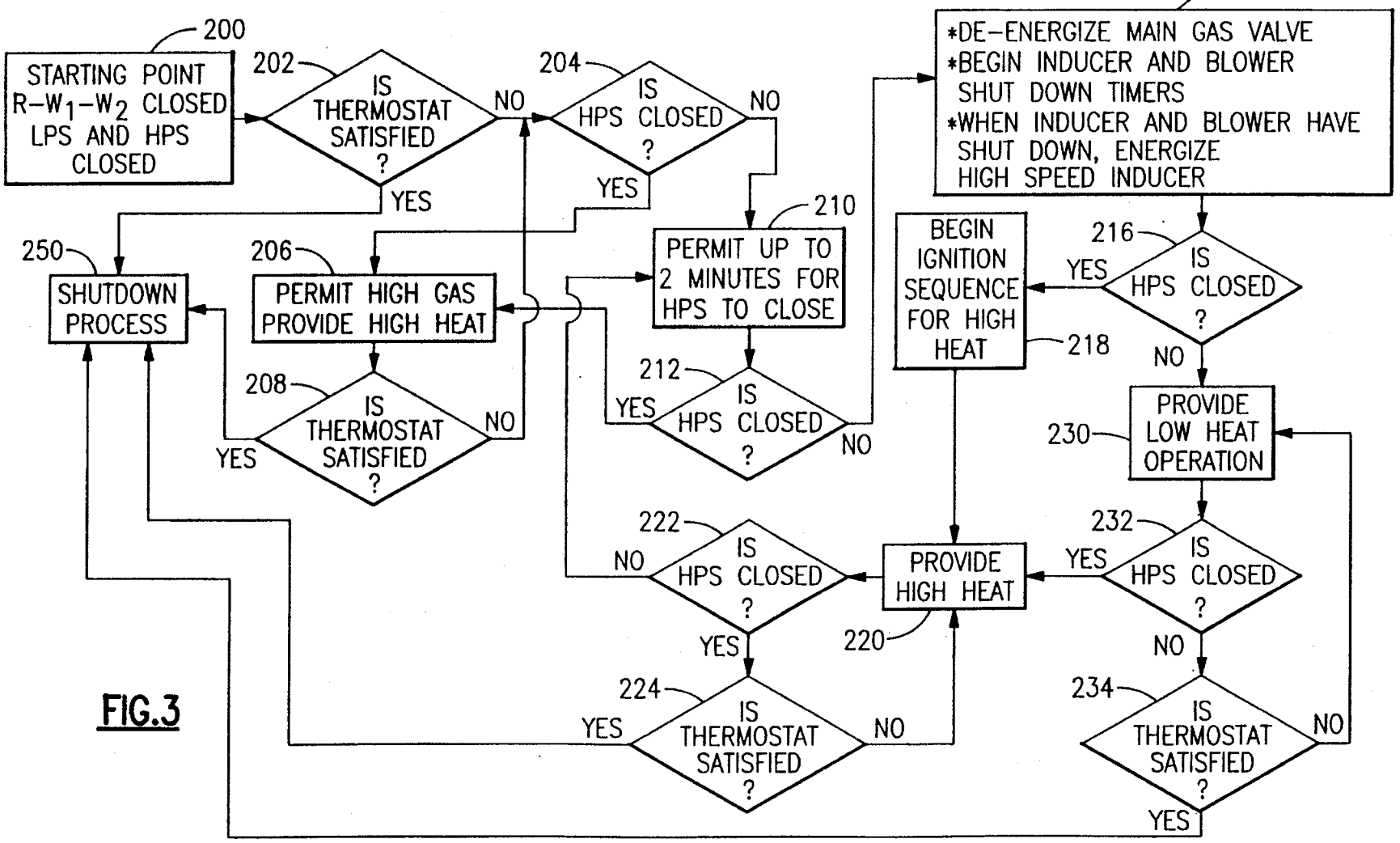
FIG. 3 is a flow chart of the process for handling the HPS opening during high-fire operation.

FIG. 3 shows the process for detecting and handling the situation where the high-fire pressure switch 14 opens when steady-state high-fire operation is in process. Initially, in 200,R-W1 and R-W2 are both closed, as are the low-fire pressure switch 8 and the high-fire pressure switch 14.

In 202a determination is made as to whether or not the thermostat is satisfied. If it is, the shutdown process of 250takes place; otherwise the HPS 14 is tested in 204.If the HPS 14 is closed, then in 206the gas flow remains set to high, providing high heat. Next a determination is made in 208as to whether the thermostat is satisfied. If so, control passes to the shutdown process of 250.If not the status of the HPS 14 is tested again in 204.

If the HPS 14 test of 204showed the HPS 14 open, then in 210the system waits for up to 2minutes. As in the earlier discussion, the choice of two minutes is based on a compromise between allowing the high-fire pressure switch 14 sufficient time to close and not delaying the delivery of high-fire heat so long as to cause discomfort to the occupant(s) of the conditioned space. Any time value in the range of 0seconds to 30minutes would be reasonable. In 212the state of HPS 14 is again tested. If it is closed, the situation has normalized and control returns to 206.If, on the other hand, it is still open, then an attempt to close it is made in 214.The main gas valve is de-energized and the inducer and blower shut down timers are started for the normal inducer post-purge and blower-off delays. When the inducer and blower have been shut down, the high speed inducer is energized. This initiation of the ignition sequence in high-speed inducer pre-purge should result in the high-fire pressure switch 14 closing, since the unfired cold purge heat exchanger pressure drop, with the inducer in high speed, is greater than the fired, low-fire heat exchanger pressure drop with the inducer in high speed.

After this attempt to close the HPS 14, its status is tested again in 216and, if it is closed, the ignition sequence for high-fire is undertaken in 218and high-fire heat is provided in 220.The HPS 14 is then tested in 222.If it is not closed, then the two minute wait of 210is implemented. If it is closed, a determination is made in 224as to whether the thermostat is satisfied. If so, then the shut down process of 250takes place and, if not, control loops to 220.

Returning now to 216,if the test there shows that the HPS 14 is not closed, then low-fire operation is continued in 230using the high-fire heating blower speed, so that there is heating to the conditioned space. Next the HPS 14 status is tested again in 232.If it is closed, control passes to 220providing high heat. If it is open, a determination is made as to whether the thermostat is satisfied in 234.If it is not, the system continues providing low heat in 230,while if it is, the system shuts down normally in 250.

In summary, if the HPS 14 opens while the system is providing high heat then, after a delay, if the HPS is still open, the system goes through a normal shutdown then a pre-purge sequence in an attempt to create a pressure differential between the high-fire pressure switch 14 and the burner area, sufficient to close the HPS 14. If this is not achieved, then heating is provided to the conditioned space using low-fire heating with high-fire heating blower speed until such time as either the thermostat call for heat is satisfied or the high-fire pressure switch 14 is closed.

Figure 6:
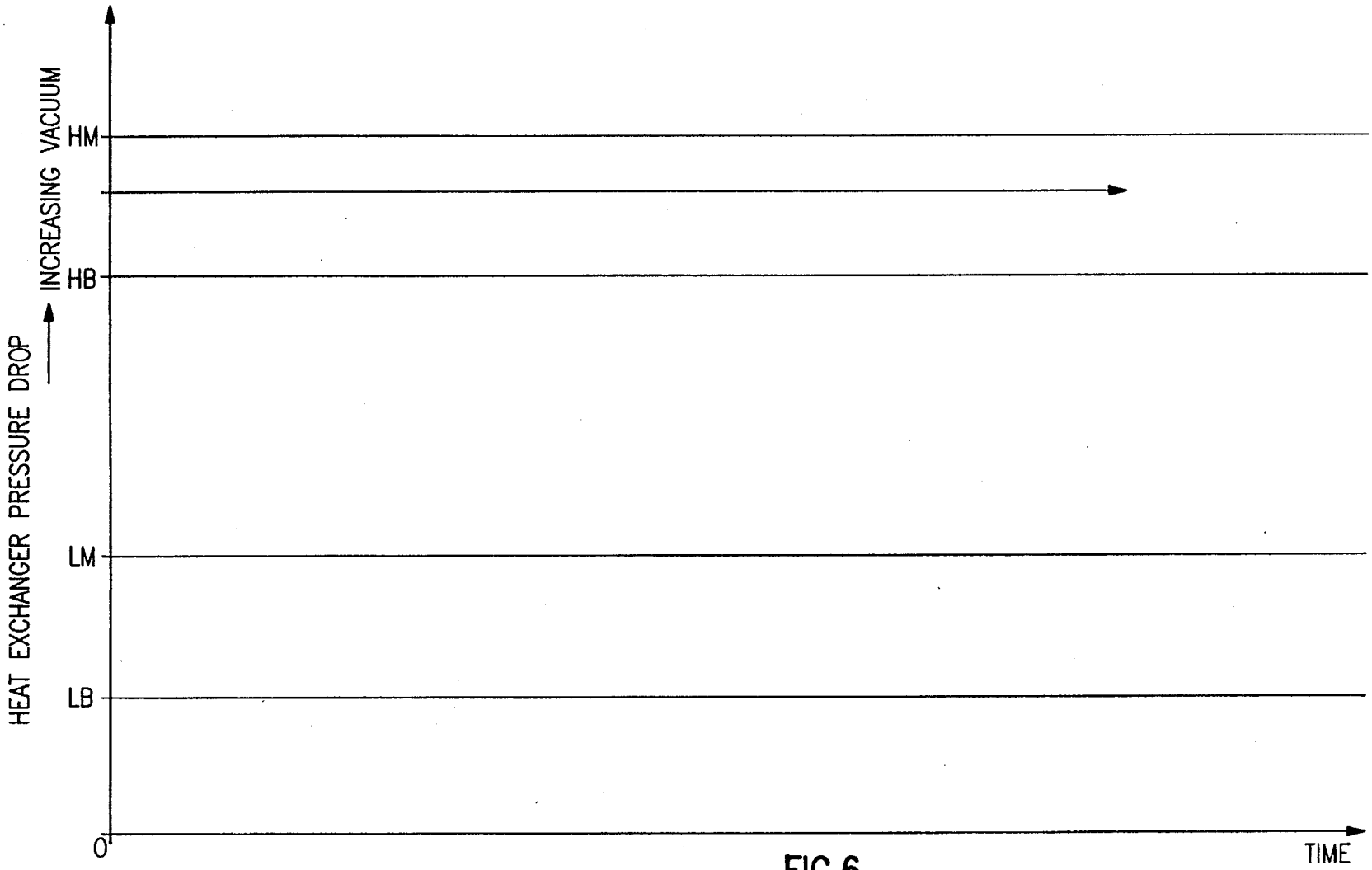
FIG. 6 is a graphical illustration of the furnace system pressure and its effect on the status of the high-fire pressure switch as a function of time during normal operation in high-fire mode where the HPS remains properly closed.
Figure 7:
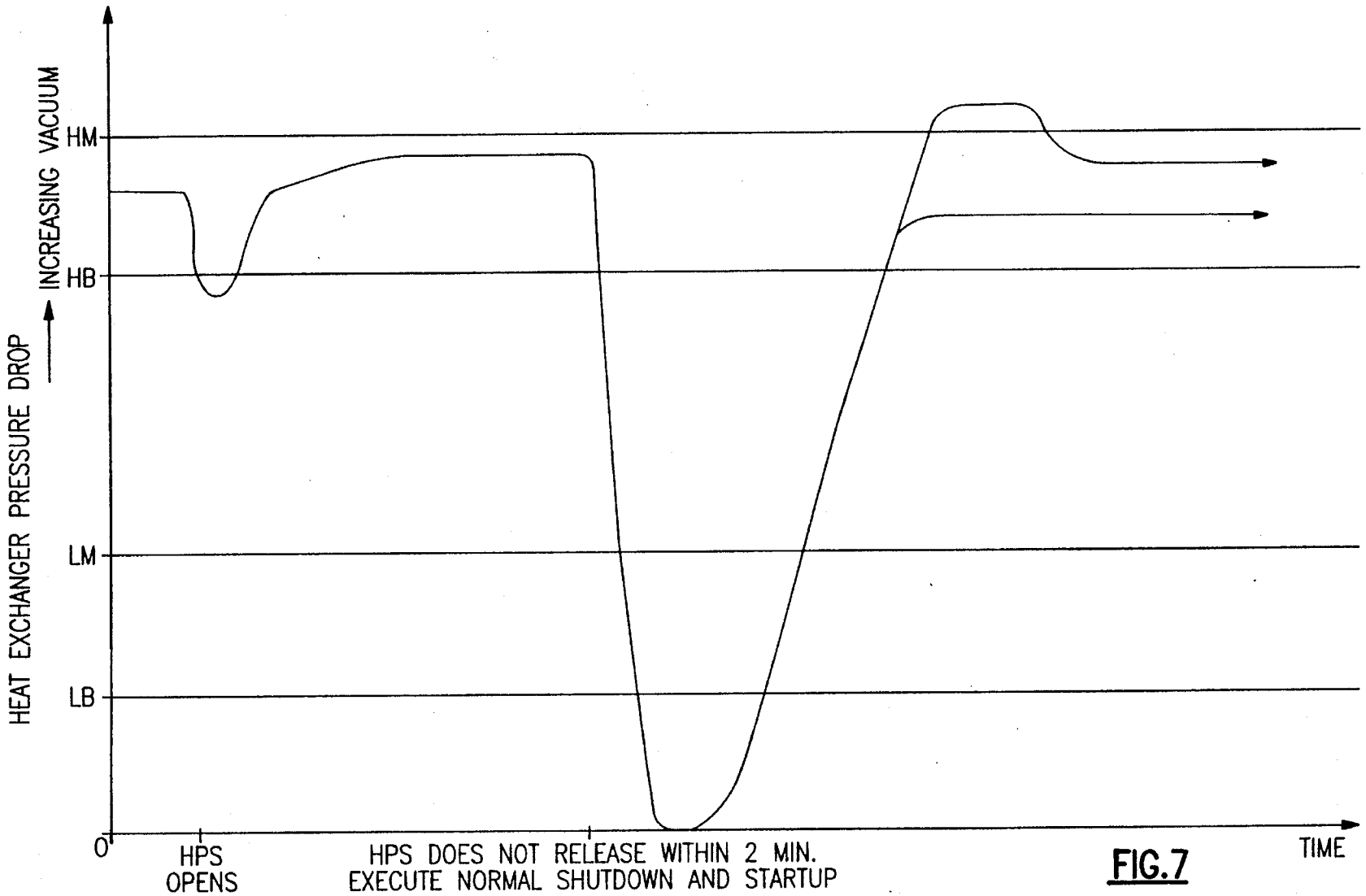
FIG. 7 is a graphical illustration of the furnace system pressure and its effect on the status of the high-fire pressure switch as a function of time during normal operation in high-fire mode where the HPS opens and the system attempts correction according to the instant invention.

FIGS. 6 and 7 contrast two different situations where the furnace is performing in high-fire mode. The normal situation is shown in FIG. 6 where the HPS 14 remains properly closed and high heat is provided continuously until such time as the thermostat is satisfied.

The case where the HPS 14 opens, whether due to a high wind gust impinging a horizontal vent or some other cause, is shown in FIG. 7. The untoward event causes the HPS 14 to open, and for two minutes the system continues operation with low-gas being provided and the high-speed inducer operation. If the HPS 14 does not close by then, shutdown procedures are initiated. Once the shutdown is complete, a normal unfired startup begins with high speed inducer operation, and thereafter either the HPS 14 will close as in line C or fail to close again as in line D.

While these examples have been explained with reference to two stage heating it should be noted that with adjustments it can also deal with extra stages in multi-stage furnaces.

While this invention has been explained with reference to the structure disclosed herein, it is not confined to the details set forth and this application is intended to cover any modifications and changes as may come within the scope of the following claims:

What is claimed is:

1. In a two-stage furnace system, including a thermostat, at least one gas burner with a low and high-fire operating capability, an inducer fan having low and high speed operating settings, and a high-fire pressure switch, a method for handling the high-fire pressure switch being in an inappropriately open condition comprising the steps of:

determining whether the thermostat is issuing a call for high heat and if it is:

determining if the high-fire pressure switch is open;

if the high-fire pressure switch is open, then waiting a predetermined time, determining if the high-fire pressure switch is still open, if the high-fire pressure switch is still open then completing a furnace shutdown sequence, initiating an ignition sequence in high-speed inducer pre-purge mode, determining if the high-fire pressure switch remains open, and if the high-fire pressure switch remains open, running the at least one gas burner in low-fire mode, and if, while said steps are being performed, the high-fire pressure switch closes, running the system in high-fire mode.

2. The method according to claim 1 wherein said predetermined time is between 0seconds and 30minutes.

3. The method according to claim 2 wherein said predetermined time is two minutes.

4. The method according to claim 1 wherein said step of initiating an ignition sequence in high-speed inducer pre-purge comprises the steps of:

de-energizing a main gas-valve;

starting inducer and blower shut down timers in normal inducer post-purge and blower-off delays; and energizing a high speed inducer.

5. The method according to claim 1, wherein when said at least one gas burner is run in said low fire-mode and said inducer fan is run at high speed.

6. The method according to claim 1 wherein said system is running at low-fire mode immediately prior to determining whether the thermostat is issuing a call for high heat.

7. In a two-stage furnace system, including a thermostat, at least one gas burner with a low and high-fire operating capability, an inducer fan having low and high speed operating settings, and a high-fire pressure switch, a method for handling the high-fire pressure switch improperly opening during high-fire heating mode comprising the steps of:

determining whether the thermostat is satisfied, and until said thermostat is satisfied:

determining if the high-fire pressure switch is open;

if the high-fire pressure switch is open, then waiting a predetermined time, determining if the high-fire pressure switch is still open, if the high-fire pressure switch is still open then completing a furnace shutdown sequence, initiating an ignition sequence in high-speed inducer pre-purge mode, determining if the high-fire pressure switch remains open, and if the high-fire pressure switch remains open, running the at least one gas burner in low-fire mode, and if, while said steps are being performed, the high-fire pressure switch closes running the system in high-fire mode.

8. The method according to claim 7 wherein said predetermined time is between 0seconds and 30minutes.

9. The method according to claim 8 wherein said predetermined time is two minutes.

10. The method according to claim 7 wherein said step of initiating an ignition sequence in high-speed inducer pre-purge comprises the steps of:

de-energizing a main gas-valve;

starting inducer and blower shut down timers in normal inducer post-purge and blower-off delays; and energizing a high speed inducer.

11. The method according to claim 7 wherein when said at least one gas burner is run in said low fire-mode said inducer fan is run at high speed.

12. In a multi-stage furnace system, including a thermostat, at least one gas burner with a low and high-fire operating capability, an inducer fan having low and high speed operating settings, and a high-fire pressure switch, a method for handling the high-fire pressure switch being in an inappropriately open condition comprising the steps of:

determining whether the thermostat is issuing a call for high heat;

determining if the high-fire pressure switch is open;

if the high-fire pressure switch is open, then waiting a predetermined time, while essentially continuously determining if the high-fire pressure switch is still open, if the high-fire pressure switch is still open then completing a furnace shutdown sequence, initiating an ignition sequence in high-speed inducer pre-purge, determining if the high-fire pressure switch remains open, and if the high-fire pressure switch remains open, running the at least one gas burner in low-fire mode, and if, while said steps are being performed, the high-fire pressure switch closes running the system in high-fire mode.

13. The method according to claim 12 wherein said predetermined time is between 0seconds and 30minutes.

14. The method according to claim 13 wherein said predetermined time is two minutes.

15. The method according to claim 12 wherein said step of initiating an ignition sequence in high-speed inducer pre-purge comprises the sub-steps of:

de-energizing a main gas-valve;

starting inducer and blower shut down timers for normal inducer post-purge and blower-off delays; and energizing a high speed inducer.

16. The method according to claim 12 wherein when said at least one gas burner is run in said low fire-mode and said inducer fan is run at high speed.

17. The method according to claim 12 wherein said system is running at low-fire mode immediately prior to determining whether the thermostat is issuing a call for high heat.

18. The method according to claim 12 wherein immediately prior to determining whether said thermostat is satisfied the system is running in high-fire mode.

* * * * *